US008833444B2

(12) United States Patent
McAfee et al.

(10) Patent No.: US 8,833,444 B2
(45) Date of Patent: Sep. 16, 2014

(54) SYSTEM, APPARATUS AND METHOD FOR ABRASIVE JET FLUID CUTTING

(71) Applicants: Wesley Mark McAfee, Montgomery, TX (US); Mark Franklin Alley, Nashville, TN (US)

(72) Inventors: Wesley Mark McAfee, Montgomery, TX (US); Mark Franklin Alley, Nashville, TN (US)

( * ) Notice: Subject to any disclaimer, the term of this patent is extended or adjusted under 35 U.S.C. 154(b) by 0 days.

(21) Appl. No.: 13/760,584

(22) Filed: Feb. 6, 2013

(65) Prior Publication Data

US 2013/0213636 A1 Aug. 22, 2013

Related U.S. Application Data

(63) Continuation of application No. 13/654,538, filed on Oct. 18, 2012, now abandoned, which is a continuation of application No. 13/292,279, filed on Nov. 9, 2011, now abandoned, which is a continuation-in-part of application No. 11/938,830, filed on Nov. 13, 2007, now abandoned.

(60) Provisional application No. 60/865,638, filed on Nov. 13, 2006.

(51) Int. Cl.
*E21B 43/11* (2006.01)
*E21B 7/18* (2006.01)

(52) U.S. Cl.
USPC ..... 166/222; 166/298; 175/67; 175/424

(58) Field of Classification Search
USPC ..... 166/222, 223, 298, 55, 55.1, 55.6; 175/67, 393, 424; 239/487; 451/75, 98, 451/102
See application file for complete search history.

(56) References Cited

U.S. PATENT DOCUMENTS

| | | | | | |
|---|---|---|---|---|---|
| 2,038,249 | A | * | 4/1936 | Stoody | 451/102 |
| 2,305,210 | A | * | 12/1942 | Wahlin | 239/601 |
| 2,804,338 | A | * | 8/1957 | Greenhow | 239/116 |
| 2,871,948 | A | * | 2/1959 | Normand | 166/222 |
| 3,072,346 | A | * | 1/1963 | Wahlin et al. | 239/487 |
| 3,104,829 | A | * | 9/1963 | Wahlin | 239/488 |
| 3,275,248 | A | * | 9/1966 | O'Brien et al. | 239/487 |
| 3,666,183 | A | * | 5/1972 | Smith | 239/463 |
| 3,705,693 | A | * | 12/1972 | Franz | 239/600 |
| 3,997,111 | A | * | 12/1976 | Thomas et al. | 239/1 |
| 4,131,236 | A | * | 12/1978 | Saunders | 239/589 |
| 4,570,860 | A | * | 2/1986 | Aprea et al. | 239/478 |
| 4,687,066 | A | * | 8/1987 | Evans | 175/340 |
| 4,739,845 | A | * | 4/1988 | Dennis | 175/393 |
| 4,787,465 | A | * | 11/1988 | Dickinson et al. | 175/67 |
| 4,790,394 | A | * | 12/1988 | Dickinson et al. | 175/61 |
| 5,199,512 | A | * | 4/1993 | Curlett | 175/67 |
| 5,291,957 | A | * | 3/1994 | Curlett | 175/67 |

(Continued)

*Primary Examiner* — Daniel P Stephenson

(74) *Attorney, Agent, or Firm* — Hulsey P.C.; William N. Hulsey, III; Jacob S. Mattis

(57) ABSTRACT

A system, apparatus and method for abrasive jet fluid cutting is provided wherein an abrasive jet fluid cutting assembly comprises a hose for receiving a coherent abrasive jet-fluid containing a solid abrasive; a helix/spring attached inside the high-pressure hose; and a jet-nozzle connected to the hose. Wherein the coherent abrasive laden jet-fluid is pumped under high pressure through the high-pressure hose and across the helix. As the jet-fluid traverses the helix, the jet-fluid rotates at a high rate creating a vortex. The disclosed subject matter further includes a system and method for using the abrasive jet fluid cutting nozzle assembly.

23 Claims, 9 Drawing Sheets

(56) References Cited

U.S. PATENT DOCUMENTS

| | | | | |
|---|---|---|---|---|
| 5,862,871 | A * | 1/1999 | Curlett | 175/340 |
| 6,668,948 | B2 * | 12/2003 | Buckman et al. | 175/67 |
| 7,114,583 | B2 * | 10/2006 | Chrisman | 175/67 |
| 7,540,327 | B2 * | 6/2009 | Billingham | 166/298 |
| 7,607,478 | B2 * | 10/2009 | Martinez et al. | 166/250.01 |
| 2003/0034156 | A1 * | 2/2003 | Gondouin | 166/52 |
| 2005/0173123 | A1 * | 8/2005 | Lund et al. | 166/361 |
| 2012/0012400 | A1 * | 1/2012 | Saccani | 175/424 |

* cited by examiner

SYSTEM, APPARATUS AND METHOD FOR ABRASIVE JET FLUID CUTTING

This application is a continuation of U.S. Non-Provisional Ser. No. 13/292,279, filed on Nov. 9, 2011, entitled "SYSTEM, APPARATUS AND METHOD FOR ABRASIVE JET FLUID CUTTING" which is a continuation-in-part of U.S. Non-Provisional Ser. No. 11/938,830, filed Nov. 13, 2007 and entitled "SYSTEM, APPARATUS AND METHOD FOR ABRASIVE JET FLUID CUTTING" which claims the benefit of U.S. Provisional No. 60/865,638 filed on Nov. 13, 2006, entitled "SYSTEM AND APPARATUS FOR A JET-FLUID CUTTING NOZZLE" and is hereby incorporated by reference.

FIELD

The present disclosure relates to drilling and cutting systems and their methods of operation and, more particularly, to a system and apparatus for a jet-fluid cutting nozzle.

BACKGROUND OF THE DISCLOSURE

Many wells today have a deviated bore horizontally drilled extending away from a generally vertical axis main well bore. The use of horizontal drilling technology has increased production fourfold over that previously achieved from vertical wells. The drilling of such sidetracking is accomplished via multiple steps. After casing and cementing a well bore, historically a multi-stage milling process is employed to vertically mill cut a window through one side of the casing. Once a vertical window is milled through the casing at the desired sidetrack or kickoff location, a directional or horizontal well drilling process may begin.

Although simple in concept, the execution of casing window milling is complicated and difficult to achieve in a timely fashion. Several complicating factors are that the well bore casing is made of steel or similarly hard material and the casing is difficult to access down a deep well borehole.

A whip-stock wedge must be placed in the casing at the desired well bore depth location and locked in place in the direction for sidetracking, as disclosed in U.S. Pat. No. 5,109,924. The whip-stock wedge can then deflect the vertical rotating milling cutter's path to one side of the casing, for milling a sidetrack or kickoff window opening through that side of the casing. The sidetrack window entry point machined through the steel casing is narrow at the top, and can cause the sidetracking rotating drill pipe to be damaged and break, because of the rubbing of the rotating drill pipe against the narrow top window opening and burrs left on the machined casing. Historically it is not uncommon to take 10 hours to complete the milling of the window profile(s) through the casing using conventional machining processes.

Abrasive casing cutting with jet nozzles has been attempted to replace conventional milling, but the present abrasive cutting processes cannot achieve proper casing window cutting required for sidetracking or horizontal drilling.

A prior art method and apparatus for cutting round perforations and an elongated slot in well flow conductors was offered in U.S. Pat. No. 4,134,453, which is hereby incorporated by reference as if fully set forth herein. The disclosed apparatus has jet nozzles in a jet nozzle head for discharging a fluid to cut the perforations and slots. A deficiency in this prior art method is that the length of the cuts that the disclosed jet nozzle makes into the rock formation is limited because the jet nozzle is stationary with respect to the jet nozzle head.

Another prior art method and apparatus for cutting panel shaped openings is disclosed in U.S. Pat. No. 4,479,541, which is hereby incorporated by reference as if fully set forth herein. The disclosed apparatus is a perforator having two expandable arms. Each arm having an end with a perforating jet disposed at its distal end with a cutting jet emitting a jet stream. The cutting function is disclosed as being accomplished by longitudinally oscillating, or reciprocating, the perforator. By a sequence of excursions up and down within a particular well segment, a deep slot is claimed to be formed.

The offered method is deficient in that only an upward motion along a well bore is possible due to the design of the expandable arms. Furthermore, the prior art reference does not provide guidance as how to overcome the problem of the two expandable arms being set against the well bore wall from preventing motion in a downward direction. A result of the prior art design deficiency is that sharp angles are formed between the well wall, thereby causing the jet streams emitted at the jets at the distal ends of the expandable arms to only cut small scratches into the well bore walls.

A further prior art method and apparatus for cutting slots in a well bore casing is disclosed in U.S. Pat. No. 5,445,220, which is hereby incorporated by reference as if fully set forth herein. In the disclosed apparatus a perforator is comprised of a telescopic and a double jet nozzle means for cutting slots. The perforator centered about the longitudinal axis of the well bore during the slot cutting operation.

The perforator employs a stabilizer means, which restricts the perforator, thus not allowing any rotational movement of the perforator, except to a vertical up and down motion. Additionally, the lifting means of the perforator was not shown or described.

An additional prior art method and apparatus for cutting casing and piles is disclosed in U.S. Pat. No. 5,381,631, which is hereby incorporated by reference as if fully set forth herein. The disclosed apparatus provides for a rotational movement in a substantially horizontal plane to produce a circumferential cut into the well bore casing. The apparatus drive mechanism is disposed down hole at the location near the cut target area. The prior art reference is deficient in that the apparatus requires multi-hoses to be connected from the surface to the apparatus for power and control.

The prior art methods are also deficient in that often the cutting line established by the cutting nozzle creates a pie or fanned shape cut as it penetrates the casing. This causes difficulty in removing the pieces cut out by conventional means, due to the fact the rear face of the piece is larger than the opening cutout by the cutting tool. This necessitates either additional cutting of the target or the angling of the line of cutting to compensate for this problem and thus yield a rear face of smaller dimensions than the front face of the casing.

Additionally, existing nozzles attempting to use a coherent abrasive laden fluid while under water (or within another liquid) have to displace the water with a gas for effective cutting of a target greater than 150 mm distance from the nozzle.

There is a need for an abrasive-jet-fluid cutting nozzle and system that is capable of creating any desired opening in the casing(s).

There is a need, therefore, for a method and apparatus of cutting precise shape and window profile(s), which can be accomplished more quickly and less expensively.

An additional need is to perforate casings, cut pilings below the ocean floor and to slot well bore casings using the unique programmed movement of a jetting-shoe.

SUMMARY OF THE DISCLOSURE

This disclosure relates to the cutting of perforation(s), slot(s), shape(s), and window(s) in submerged down-hole well bore casing(s) whose inside diameter is about 100 mm or larger, and more particularly, to the controlled and precise use of a jet-fluid and nozzle configuration to cut perforation(s), slot(s), shape(s) and window(s) through a well bore casing or multiple nested well bore casings, thereby facilitating and providing access to the formation structure beyond the casing(s) or completely severing a single or multiple nested well bore casings where the casing(s) may be cemented in place at any depth.

Programmed movement of a jetting-shoe and abrasive-jet-nozzle allows lower kick off points and landing early in the reservoir, due to the ability of short radius sidetracking provided by cutting larger and longer casing window sections than is possible with conventional machining processes.

Short-radius technology is employed for the re-entry of existing vertical wells and to prevent having to kick off the well into problem zones. Short-radius wells are those with a build-up rate higher than 25°/30 m.

Another aspect of using programmed movement of a jetting-shoe and abrasive-jet-nozzle is that it eliminates the requirement to first deploy a whip-stock wedge placed in the casing at the desired well bore depth location required for sidetracking during conventional milling of the casing window.

The present disclosure has been made in view of the above circumstances and has as an aspect a down hole jet-fluid cutting apparatus capable of cutting well-bore casing(s) by the application of coherent high-pressure abrasive fluid mixture.

A further aspect of the present disclosure is a novel nozzle and nozzle configuration creating a vortex in the region directly in front of the nozzle and that vortex travels downstream a distance away from the nozzle and thereby generates additional cutting and penetrating capabilities.

An additional aspect of the present disclosure is the ability to use a flexible hose attached directly to the jet nozzle.

Yet another aspect of the present disclosure is the ability to use the device in well bores at least 100 mm in diameter.

Still another aspect of the disclosed subject matter is extended effective cutting distances from the nozzle.

Another aspect of the disclosed subject matter is cutting at great depth. An additional aspect of the disclosed subject matter is the ability to conduct coherent abrasive jet-fluid cutting under water or submerged in another liquid.

To achieve these and other advantages and in accordance with the purpose of the present disclosure, as embodied and broadly described, the present disclosure can be characterized according to one aspect of the present disclosure as comprising a down-hole jet-fluid cutting apparatus, the apparatus including a jet-fluid nozzle, a high-pressure pump, wherein the high-pressure pump exerts pressure on a motive fluid. The motive fluid from the high-pressure pump, propels a fluid abrasive mixture from an abrasive mixing unit that is capable of maintaining a coherent abrasive fluid mixture, into a high-pressure conduit for delivering the coherent high-pressure abrasive mixture to the down-hole jet-fluid nozzle.

A jet-fluid nozzle jetting-shoe is employed, wherein the jetting-shoe is adapted to receive the jet-fluid nozzle and direct the coherent high-pressure jet-fluid abrasive mixture towards a casing or target, wherein the jetting-shoe controlling unit further includes at least one servomotor for manipulating the work string and the jetting-shoe along a vertical and horizontal axis.

A central processing unit having a memory unit, wherein the memory unit is capable of storing profile generation data for cutting a predefined shape or window profile in the target. The central processing unit further includes software, wherein the software is capable of directing the central processing unit to perform the steps of: controlling the jetting-shoe control unit to manipulate the jetting-shoe along the vertical and horizontal axis to cut a predefined shape or window profile in the target. The jetting-shoe control unit controls the speeds and feeds of the work string in the vertical and horizontal axial movement of the tubing-work-string and jetting-shoe to cut a predefined shape or window profile in the target. The software controls the percentage of the abrasive fluid mixture to total fluid volume and also controls pressure and flow rates of the high-pressure pump.

Inserting a jetting-shoe assembly via a tubing-work-string into an annulus of the well bore casing to the milling site depth and attaching rotating centralizers on an outer diameter surface of the tubing-work-string to center the tubing-work-string in the annulus. Milling of the site via an abrasive-jet fluid from the jetting-shoe assembly is performed, wherein the computer implements a predefined shape or window profile at the milling site by controlling the vertical movement and horizontal movement through a 360 degree angle of rotation of the jetting-shoe assembly.

It is to be understood that both the foregoing general description and the following detailed description are exemplary and explanatory only and are not restrictive of the disclosure, as claimed.

BRIEF DESCRIPTION OF THE DRAWINGS

The accompanying drawings, which are incorporated in and constitute a part of this specification, illustrate embodiments of the disclosure and together with the description, serve to explain the principles of the disclosure.

DETAILED DESCRIPTION OF THE DISCLOSURE

Figure 1:
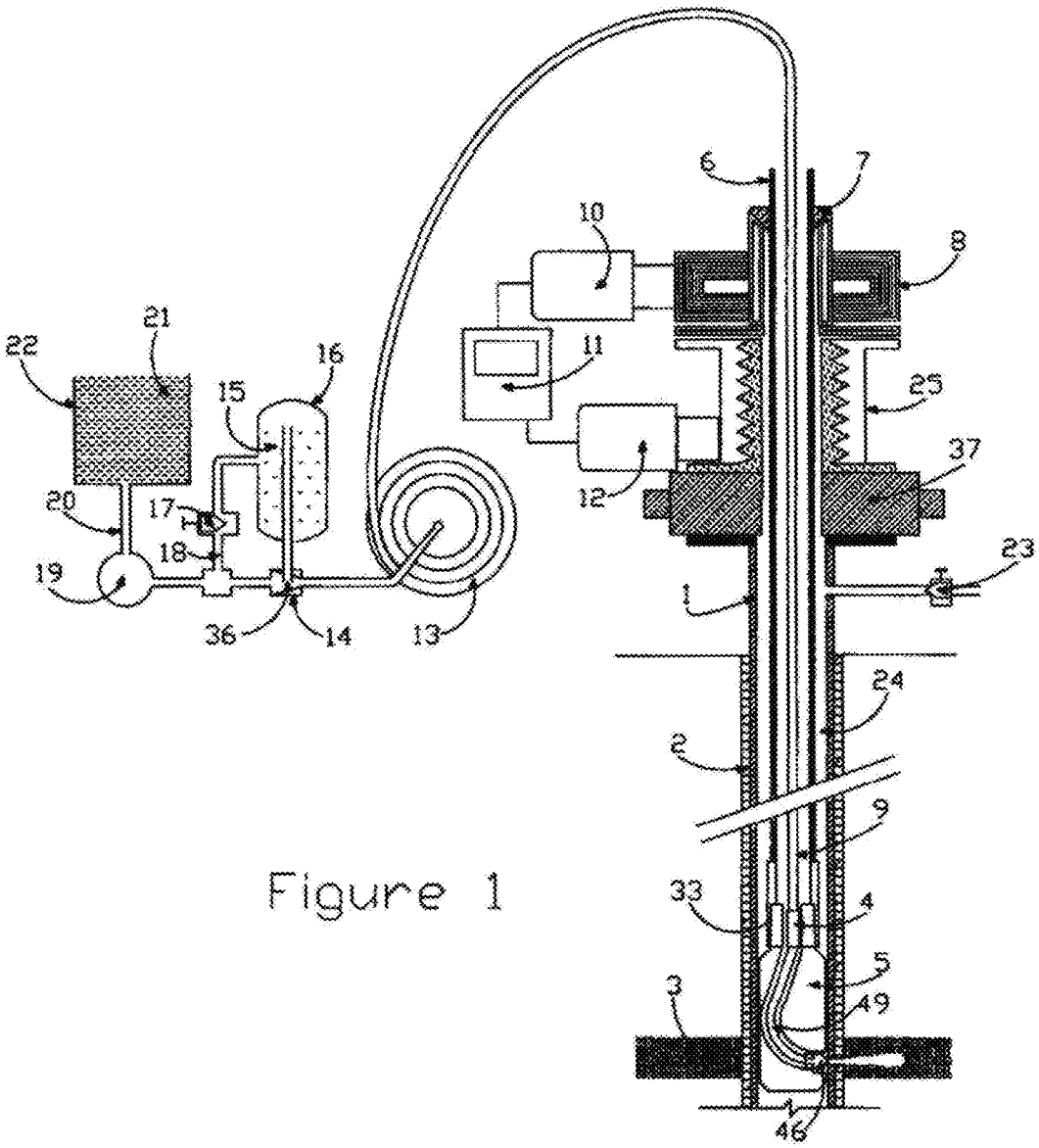
FIG. 1 is a two dimensional cutaway view showing an embodiment of the programmable abrasive-jet-fluid cutting system of the present disclosure.

Reference will now be made in detail to the present embodiments of the disclosure, examples of which are illustrated in the accompanying drawings. Wherever possible, the same reference numbers will be used throughout the drawings to refer to the same or like parts (elements).

To help understand the advantages of this disclosure the accompanying drawings will be described with additional specificity and detail.

The present disclosure generally relates to methods and apparatus of abrasive-jet-fluid cutting through well bore casing or similar structure. The method generally is comprised of the steps of positioning a jetting-shoe and jet-nozzle adjacent to a pre-selected location of casing in the annulus, pumping a motive fluid containing abrasives through the jet-nozzle such that the fluid is jetted there from cutting through the casing, while moving the jetting-shoe and jet-nozzle in a predetermined programmed vertical axis and 360 degree horizontal rotary axis.

In one embodiment of the present disclosure the vertical and horizontal movement pattern(s) are capable of being performed independently of each or programmed and operated simultaneously. The abrasive-jet-fluid there from is directed and coordinated such that the predetermined pattern is cut through the inner surface of the casing to form a shape or window profile(s), allowing access to the formation beyond the casing.

A jetting-shoe control unit simultaneously moves a jetting-shoe in a vertical axis and 360-degree horizontal rotary axis to allow cutting the casing, cement, and formation rock, in any programmed shape or window profile(s). A coiled tubing for delivering a coherent high-pressure abrasive-jet-fluid through a single tube and a jet-nozzle for ejecting there from abrasive-jet-fluid under high-pressure from a jetting-shoe is contemplated and taught by the present disclosure. Coiled tubing well intervention has been known in the oil production industry for many years. Additional conductors such as high-pressure hoses and tubing-work-strings can deliver the coherent high-pressure abrasive-jet-fluid to the jetting-shoe.

The jetting-shoe control unit apparatus and means are programmable to simultaneously or independently provide vertical axis and 360-degree horizontal rotary axis movement under computer control. A computer having a processor and memory and operating pursuant to attendant software, stores shape or window profile(s) templates for cutting and is also capable of accepting inputs via a graphical user interface, thereby providing a system to program new shape or window profile(s) based on user criteria. The memory of the computer can be one or more of but not limited to RAM memory, flash memory, ROM memory, EPROM memory, EEPROM memory, registers, hard disk, a removable disk, an optical drive, floppy disk, DVD, CD disk or any other form of storage medium known in the art. In the alternative, the storage medium may be integral to the processor. The processor and the storage medium may reside in an ASIC or microchip.

The computer of the present disclosure controls the profile generation servo drive systems as well as the abrasive mixture percentage to total fluid volume and further controls the pressure and flow rates of a high-pressure pump and pump drive. The computer further controls the feed speed position of the fluid-tube fed through the coiled tubing injector head and the simultaneous jacking and the directional rotation of the tubing-work-string in an annulus. Telemetry is broadcast and transmitted by a sensor or probe located in the jetting-shoe after scanning of the cut shape or window profile(s) after the casing has been cut.

In an alternate embodiment of the present disclosure the abrasive-jet-fluid method and apparatus is capable of cutting into the underlying substructure, such as rock or sediment.

In a further embodiment of the present disclosure the abrasive-jet-fluid cutting apparatus can be directed to cut or disperse lodged impediments blocking the well bore casing annulus. Impediments such as measuring equipment, extraction tools, drill heads or pieces of drill heads and various other equipment utilized in the industry and readily recognizable by one skilled in the art, periodically become lodged in the well bore and must be removed before work at the site can continue.

In a still further embodiment multiple jet heads can be employed to form simultaneous shapes or window profiles in the well bore casing or underlying substructure, as the application requires. This type of application, as appreciated by one skilled in the art, can be employed to disperse impediments in the well bore or to severe the well bore casing at a desired location so that it can be extracted. Additionally, this embodiment can be employed where a rock formation or other sub-structure is desired to be shaped symmetrically or asymmetrically to assist in various associated tasks inherent to the drilling or extraction process.

In a still further embodiment of the present disclosure the vertical axis of the cutting apparatus is capable of being manipulated off the plane axis to assist in applications wherein the well bore is not vertical, as is the case when directional drilling is employed.

In one embodiment of the present disclosure, the jetting-shoe is attached to a tubing-work-string and suspended at the wellhead and is moved by the computer, central processing unit or micro-chip (collectively called the computer) controlled servo driven units. Software in communication with sub-programs gathering telemetry from the site directs the computer, which in turn communicates with and monitors the down hole cutting apparatus and its attendant components, and provides guidance and direction simultaneously or independently along the vertical axis and the horizontal axis (360-degrees of movement) of the tubing-work-string via servo driven units.

The shape or window profile(s) that are desired are programmed by the operator on a programmable logic controller (PLC), or personal computer (PC), or a computer system designed for this specific use. The integrated software, via a graphical user interface (GUI), accepts inputs from the operator and provides the working parameters and environment by which the computer directs and monitors the cutting apparatus.

The rotational computer controlled axis servo motor, such as a Fanuc model D2100/150is servo, provides 360-degree horizontal rotational movement of the tubing-work-string using a tubing rotator such as R and M Energy Systems heavy duty model RODEC RDII, or others, that have been modified to accept a mechanical connection for the servo drive motor. The tubing-work-string rotator supports and rotates the tubing-work-string up to 58 metric tonnes. Geared slewing bearing rotators may also be used as will be apparent to those skilled in the art.

The vertical axis longitudinal computer controlled servo axis motor, such as Fanuc D2100/150is servo, provides up and down vertical movement of the tubing-work-string using a jack assembly attached to the top of the wellhead driven by said servo drive motor. The jack could employ ball screw(s) for the ease of the vertical axis longitudinal movements, although other methods may be employed. The jack may have a counter balance to off set the weight of the tubing-work-string to enhance the life of the servo lifting screw(s) or other lifting devices such as Joyce/Dayton model WJT 325WJ3275 screw jack(s).

The servos simultaneously drive the tubing-work-string rotator and jack, providing vertical axis and 360-degree horizontal rotary axis movement of the tubing-work-string attached to the down-hole jetting-shoe. The shape or window profile(s) cutting of the casing is thus accomplished by motion of the down hole jetting-shoe and the abrasive-jet-fluid jetting from the jet-nozzle into and through the casing, cement, tools, equipment and/or formations.

The abrasive-jet-fluid in one embodiment of the present disclosure is delivered by a coiled tubing unit through a fluid-tube to the jetting-shoe through the inner bore of the tubing-work-string, or the abrasive-jet-fluid can be pumped directly through the tubing-work-string, with the jet-nozzle being attached to the exit of the jetting-shoe.

The abrasive-jet-fluid jet-nozzle's relative position to the target is not critical due to the long reach coherent stream of the abrasive-jet-fluid. The jet-nozzle angle nominally is disposed at approximately 90 degrees to the inner well bore surface, impediment or formation to be cut, but may be positioned at various angles in the jetting-shoe for tapering the entry hole into the casing and formation by the use of different angles where the jet-nozzle exits the jetting-shoe.

The minimum 600 mm reach of the coherent stream abrasive-jet-fluid jet-nozzle's abrasive-jet-fluid makes possible the slotting and window cutting through multiple nested cemented well bore casings. The long reach of the coherent stream abrasive-jet-fluid exiting from the jet-nozzle as described herein, allows cutting multiple slots vertically into the ID circumference of the first casing facing the jet-nozzle, and then through multiple nested casing into the rock formation.

While cutting the vertical slots through the casing, the rotating abrasive jet stream from the jet-nozzle erodes the cement between the first and other nested casing. The resulting cement slurry generated from between the nested casing during the cutting may be either pumped to the surface or left to settle into the well bore hole.

Empirical tests cutting 25 mm radial spaced vertical 300 mm length slots, with all slots starting at the same depth, removed all the cement between the casing and formation. The method of removing the cement between the nested casing and leaving the resulting skeleton casing in place allow complete cementing from one side of the formation to the opposite side giving a "rock to rock" cement plug for shutting in wells permanently. The casing skeleton left in place from the slotting and cement removal provides additional strength to the cement plug.

The method for preparing the well for cement plugging is to first deploy a tubing-work-string of sufficient length into the well bore annulus using a work over rig with the jetting-shoe assembly attached on the end of the work string. A casing log may be consulted, at the zone where the well is to be plugged, along with casing collar locations for information for programming the jetting-shoe apparatus. A program is entered into the computer where the jet-fluid nozzle jetting-shoe has been deployed, wherein the jetting-shoe is adapted to receive the jet-fluid nozzle and direct the coherent high-pressure jet-fluid abrasive mixture towards a casing or target.

The high-pressure pump is turned on and coherent abrasive fluid is pumped from the abrasive mixer into a high-pressure hose, or a tubing-work-string, or coiled tubing, then through the jetting-shoe assembly exiting the attached jet-nozzle to a predefined point at the target. Observing about a 4 to 7 bar drop on the high pump pressure gage, either on the pump or in the control cab, that relates to the abrasive-jet fluid has blown a hole through the target, then start the programmed vertical movement of the jetting-shoe apparatus at 300 mm per minute, cutting a slot 1.5 meters in length. Slot cut length without re-positioning the work-string is dependent on the stroke of the vertical lifting jacks of the jetting-shoe control unit. After cutting the slot, the computer turns off the high-pressure pump, and then rotates or indexes the jetting-shoe assembly via the program and horizontal axial movement of the work string and jetting-shoe to a predefined location, and the computer goes into a feed hold. The operator observes jetting-shoe location and then turns on the high-pressure pump. After verification of a 4 to 7 bar pressure drop, that indicates a hole has been blown through the casing at the second location, the operator starts the computer and slotting is begun in the opposite direction of the first slot by the jetting-shoe control unit. A slot is cut up to 1.5 meters in length (again, slot length is dependent on the stroke of the access tool and can be any reasonable length) in that direction and the computer turns off the high-pressure pump, rotates or indexes the horizontal axial movement of the work string and jetting-shoe to a predefined location and the computer goes into a feed hold. The operator again starts the high-pressure pump, verifies hole penetration through the casing by observing the high-pressure gage in the cab or at the high-pressure pump and starts another vertical slot in the opposite direction as the last slot. This process is repeated until the casing slotting at that zone is completed. The work string is then moved by the jetting-shoe control unit on top of the well, either up or down, according to which zone is to be slotted next, and another round of slotting starts again. This sequence is repeated until the casing is slotted the length required.

It is possible in eight to ten hours to cut 11 equally spaced, 12 m length slots inside a 178 mm casing that is nested inside of a 245 mm cemented casing and into the formation using one jet-nozzle.

The inner most casing collars are not slotted to give integrity of the slotted skeleton casing left in place after slotting.

Empirical tests have shown at 1,200 m depth, 300 mm length per minute cutting was achieved, pumping at 1,100 bar, 60 liters per minute of 8% abrasive by weight coherent abrasive jet-fluid, through a 1.2 mm diameter jet-nozzle to cut through a fluid filled steel cemented 178 mm well casing 12 mm thick.

In an alternate embodiment, empirical tests have shown that fluid pressure below 690 bar with varying orifice sizes and water flow rates will provide sufficient energy and abrasion to cut through the well bore casing or formation, but at a cost of additional time to complete the project. As will be appreciated by those skilled in the art, variations in the jet-nozzle orifice size or the abrasive component utilized in the cutting apparatus fluid slurry will generally necessitate an increase or decrease in the fluid slurry flow rate as well as an increase or decrease in the pressure required to be applied to the coherent abrasive-jet fluid (slurry). Additionally, the time constraints attendant to the specific application will also impinge upon the slurry flow rate, pressure and orifice sizes selected for the specific application undertaken.

As an additional example, in real world tests, with the target and nozzle both under water, a 1.2 mm diameter nozzle operating at 69 bar and 26 liters per minute abrasive-jet fluid, cut through 1.5 mm thick metal from a distance of one meter.

One advantage of the present disclosure over the prior art is that the attendant costs of cutting through the well bore casing or formation will be relatively nominal as compared to the total drilling costs. In addition, the present disclosure provides that any additional costs of operation of the cutting apparatus may be significantly offset by the decreased site and personnel costs.

The methods and systems described herein are not limited to specific sizes or shapes. Numerous objects and advantages of the disclosure will become apparent as the following detailed description of the multiple embodiments of the apparatus and methods of the present disclosure are depicted in conjunction with the drawings and examples, which illustrate such embodiments.

A work-over-rig or a drill rig is utilized to attach a jetting-shoe to the end of a tubing-work-string, which are inserted into the annulus of the cased well bore to a point down hole in the annulus, where a user programmable shape or window profile(s) are to be abrasive-jet-fluid cut through the casing and cement, to expose formation rock.

Next, air or other slips are set around the tubing-work-string in the tubing rotator thereby suspending and holding the tubing-work-string. Thus, allowing the shape or window jetting-shoe control unit to be able to simultaneously move the vertical axis and 360 degree horizontal rotary axis of the tubing-work-string under computer program control, The method for cutting user programmable shapes or window profile(s) through down hole casing further includes inserting a fluid-tube, that is fed from a coiled tubing unit and coiled tubing injector head, into the bore of the work-string which is suspended by the rotator and jack of the jetting-shoe control unit, so the jet-nozzle attached to the end of the fluid-tube is fed through the jetting-shoe to face the inner surface of the casing.

An operational cycle of the computer control unit is then commenced, which positions the jetting-shoe and jet-nozzle into the proper location for cutting the user programmable shapes or window profile(s), which in turn engages the high-pressure pump and drives the two-axis programmable computer servo controller unit at the surface to generate the user programmable shape or window profile(s) to cut through the casing or through a plurality of metal casings of varying diameters stacked within each other and sealed together with cement grout.

The computer further controls the coiled tubing unit and the feed speed of the coiled tubing injector and depth location of the jet-nozzle attached to the end of the fluid-tube. A co-ordinate measuring of the cut shapes or window profile(s) is performed by scanning with a magnetic proximity switch on the jetting-shoe that faces the inner surface of the annulus. The cutting apparatus and its attendant components are rotated and raised and lowered by the jetting-shoe control unit under computer control.

The magnetic (or other) proximity switch senses the casing in place, or the casing that has been removed by the abrasive-jet-fluid, and activates a battery operated sonic transmitter mounted in the jetting-shoe, which transmits a signal to a surface receiver, that is coupled to the computer control unit containing the data of the originally programmed casing cut shapes or window profile(s) for comparison to the user programmed shape or window profile(s).

FIG. 1 depicts a well bore lined with a casing 1. Casing 1 is typically cemented in the well bore by cement bond 2, wherein cement bond 2 is surrounded by a formation 3. A jetting-shoe 5 is illustrated in FIG. 1 with a jet nozzle 46 attached to the end of fluid-tube 9. The jetting-shoe 5 is depicted with a threaded joint 33 attached at a lower end of a string of drill or tubing-work-string 6. Drill pipe or tubing-work-string 6 and jetting-shoe 5 are lowered into annulus 24 of the well at or near a location where a shape or window profile(s) is to be cut and is suspended by casing adaptor flange 7 in by tubing rotator 8.

FIG. 1 further depicts jetting-shoe 5 in position with a fluid-tube 9 being fed into the drill or tubing-work-string 6 by a coiled tubing injector head (not shown) from a coiled tubing reel 13 through the jetting-shoe 5. The fluid-tube 9 is transitioned from a vertical to horizontal orientation inside of the jetting-shoe 5 such that the jet-nozzle 46 is in disposed in proximity to casing 1 that is to be cut. The reader should note that although the drawings depict a well casing being cut into, the target could very well be an impediment such as an extraction tool or other equipment lodged in the casing.

The shape or window profile(s) are programmed into the computer 11 via a graphical user interface (GUI) and the high-pressure pump 19 is initiated when the operator executes the run program (not shown) on the computer 11. The computer 11 is directed by sub-programs and parameters inputted into the system by the user. Additionally, previous cutting sessions can be stored on the computer 11 via memory or on a computer readable medium and executed at various job sites where the attendant conditions are such that a previously implemented setup is applicable.

Fluid 21 to be pumped is contained in tank 22 and flows to a high-pressure pump 19 through pipe 20. The high-pressure pump 19 increases pressure and part of the fluid flows from the high-pressure pump 19 is diverted to flow pipe 18 and then into fluid slurry control valve 17 and into abrasive pressure vessel 16 containing abrasive material 15. Typically a 10% flow rate is directed via flow pipe 18 and fluid slurry control valve 17 to the abrasive pressure vessel 16. The flow rate is capable of being adjusted such that the abrasive will remain suspended in the fluid 21 utilized. In examples of predictive cutting times, the base line flow was modulated to provide an abrasive concentration by weight to fluid ratio of about 8%. The maintaining of an abrasive to concentration fluid ratio is an important element in the present disclosure as well as the type of abrasive, such as sand, Garnet, various silica, copper slag, synthetic materials or Corundum are employed.

The volume of fluid directed to the abrasive pressure vessel 16 is such that a fluid, often water, and abrasive slurry are maintained at a sufficient velocity, such as 2.4 to 10 meters per second through fluid-tube 9, so that the abrasive is kept in suspension through the jet-nozzle 46. A velocity too low will result in the abrasive falling out of the slurry mix and clumping up at some point, prior to exiting the jet-nozzle 46. This ultimately results in less energy being delivered by the slurry at the target site.

Figure 6:
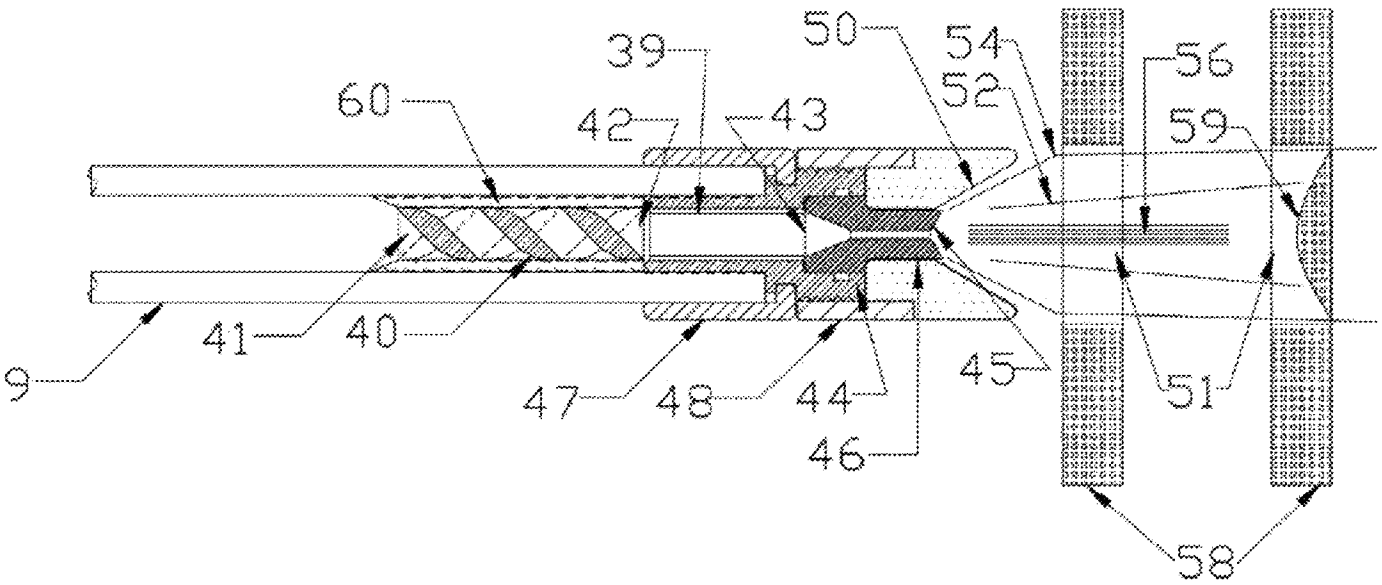
FIG. 6 is a perspective view of an embodiment of an assembled nozzle configuration of an aspect of the present disclosure.

Furthermore, a velocity too high will result in similarly deleterious effects with respect to the energy being delivered by the slurry at the target site. FIG. 6 This is because of the stagnation region of a nozzle throat being too long for the fluid velocity inside the throat of the nozzle.

FIG. 1 The abrasive material 15, such as sand garnet or silica, is mixed with the high-pressure pump 19 fluid flow at mixing valve 14. Mixing valve 14 further includes a venturi 36, which produces a jet effect, thereby creating a vacuum aid in drawing the abrasive water (slurry) mix. With the above-described orientation the slurry exiting the jet-nozzle 46 can achieve high velocities and be capable of cutting through practically any structure or material.

The coherent abrasive-jet-fluid then flows through coiled tubing reel 13 and down fluid-tube 9 and out jet-nozzle 46 cutting the casing 1 and the cement bond 2 and the formation 3. Although the drawings and examples refer to cutting or making a shape or window profile in the well bore casing, it should be understood by the reader that the present disclosure is not limited to this embodiment an application alone, but is applicable and contemplated by the inventors to be utilized with regard to impediments and other structures as described above.

In an alternate embodiment an abrasive with the properties within or similar to the complex family of silicate minerals such as garnet is utilized. Garnets are a complex family of silicate minerals with similar structures and a wide range of chemical compositions and properties. The general chemical formula for garnet is AB (SiO), where A can be calcium, magnesium, ferrous iron or manganese; and B can be aluminum, chromium, ferric iron, or titanium.

More specifically the garnet group of minerals shows crystals with a habit of rhombic dodecahedrons and trapezohedrons. They are nesosilicates with the same general formula, $A_3B_2(SiO_4)_3$. Garnets show no cleavage and a dodecahedral parting. Fracture is conchoidal to uneven; some varieties are very tough and are valuable for abrasive purposes. Hardness is approximately 6.5-9.0 Mohs; specific gravity is approximately 2.1 for crushed garnet.

Garnets tend to be inert and resist gradation and are excellent choices for an abrasive. Garnets can be industrially obtained quite easily in various grades. In the present disclosure, empirical tests performed utilized an 80-grit garnet.

A person of ordinary skill in the art will appreciate that the abrasive material 15 is an important consideration in the cutting process and the application of the proper abrasive with the superior apparatus and method of the present disclosure provides a substantial improvement over the prior art.

The cutting time of the abrasive-jet-fluid is dependant on the material and the thickness cut. The computer 11 processes input data and telemetry and directs signals to servomotor 10 and servomotor 12 to simultaneously move the tubing-work-string rotator 8 and tubing-work-string jack 25 to cut the shapes or window profile(s) that have been programmed into the computer 11. Predetermined feed and speed subprograms are incorporated into the software to be executed by computer 11 in the direction and operation of the cutting apparatus.

Any excess fluid is discharged up annulus 24 through choke 23. The steel that is cut during the shaping or cutting process drops below the jetting-shoe 5 and can be caught in a basket (not shown) hanging below or be retrieved by a magnet (not shown) attached to the bottom of the jetting-shoe 5 if required. If desirable the steel or other material (e.g. formation rock, cement, tools, etc.) may be allowed to fall down into the open hole below the cut.

Figure 2:
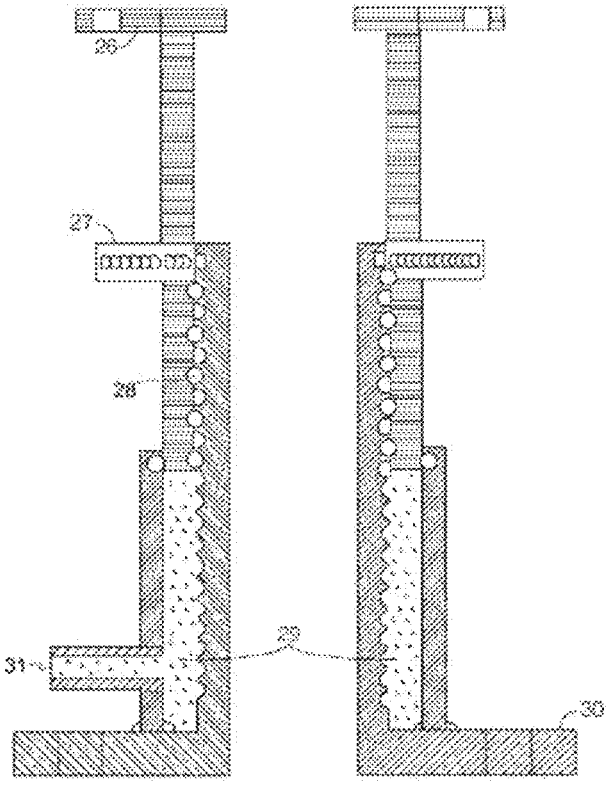
FIG. 2 is a two dimensional cutaway view depicting an embodiment of the jack of the present disclosure.

Tubing-work-string jack 25 is driven in the vertical axis by a worm gear 27, depicted in FIG. 2, which is powered by a servo motor (not shown) that drives a ball screw 28. The tubing-work-string jack 25 is bolted on the wellhead 37 at flange 30. The tubing-work-string jack 25 is counterbalanced by the hydraulic fluid 29 that is under pressure from a hydraulic accumulator cylinder under high-pressure 31. The rotator is attached on the top of the tubing-work-string jack 25 at flange 26.

Figure 3:
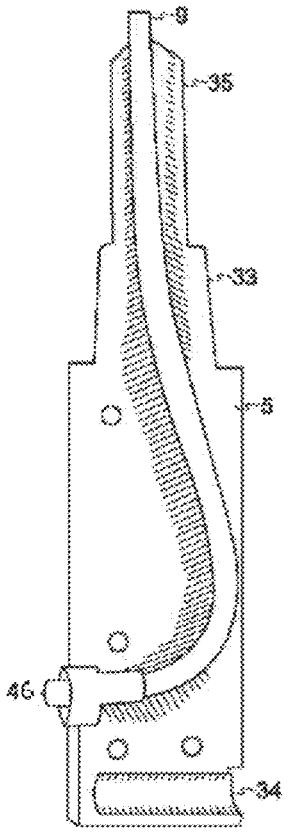
FIG. 3 is a three-dimensional cutaway view of an embodiment of a jetting-shoe of the present disclosure.

The jetting-shoe 5, as illustrated in FIG. 3, is typically made of 316 stainless steel or similarly resilient material. The jetting-shoe 5 is connected to the tubing-work-string 6 with threads 33. Stabbing guide 35, a part of the jetting-shoe 5, is disposed inside of tubing-work-string string 6 that supports the guiding of the flow-tube 9 into the jetting-shoe 5. The flow-tube 9 transitions from a vertical axis to a horizontal axis inside of the jetting-shoe 5. The jet-nozzle 46 is coupled to the fluid-tube 9 and disposed such that it faces the surface face of the well-bore casing and the coherent abrasive-jet-fluid exits the jet-nozzle 46 and cuts the casing 1.

A battery operated sonic transmitter and magnetic proximity switch, not shown, are installed in borehole 34 of the jetting-shoe 5 to allow scanning of the abrasive-jet-fluid cuts through the casing 1. Telemetry is transmitted via a signaling cable to computer 11. The signaling cable, not shown, may be of a shielded variety or optical in nature, depending on the design constraints employed.

In another embodiment a battery operated sonic transmitter and magnetic proximity switch, not shown, are installed in borehole 34 of the jetting-shoe 5 to allow scanning of the abrasive-jet-fluid cuts through the casing 1. Telemetry is transmitted via sound waves to computer 11.

In another embodiment based on a 15,000-PSI pressure delivered to the jet-nozzle 46 comprising a 1.2 mm diameter orifice, the jet-nozzle 46 is made of boron carbide or silicon carbide.

For instance, the casing material to be cut is a variable, as well as the diameter of the casing. In one instance the diameter of the casing could be 101 mm and another 1,200 mm in diameter.

Based on these constraints and many others, the cutting times desired, cutting rate attainable, jet-nozzle size orifice, abrasive material on hand or selected, pressure to be delivered at the work site, as well as safety concerns and the depletion of the equipment deployed are incorporated into the final calculations and either programmed or inputted into the computer 11.

Additional empirical tests have demonstrated that in one embodiment of the present disclosure the operational range contemplated is between approximately 690 bar and 2,750 bar with a nominal working range of approximately 1,100 bar.

Figure 4A:
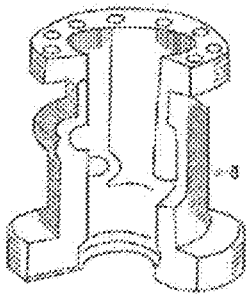
FIGS. 4A and 4B are three dimensional cutaway views of a rotator of the present disclosure.
Figure 4B:
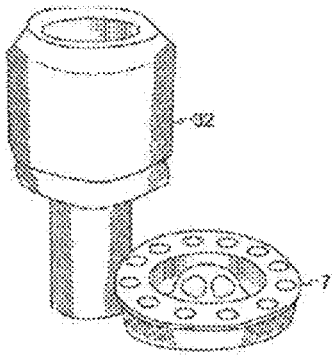

FIGS. 4A and 4B depict a rotator-casing bowl 8, such as R and M Energy Systems heavy-duty model RODEC RDII, secured on top of tubing-work-string string jack 25. The tubing-work-string 6 is inserted through (see FIG. 4B) casing adaptor flange 7, which is further disposed on top of pinion shaft 32. Pinion shaft 32 is adapted to secure and suspend the tubing-work-string 6 within the annulus 24. The 360-degree rotary movement of the tubing-work-string 6 is accomplished by the pinion shaft 32, which is powered by servomotor 10. The present disclosure may be embodied in other specific forms without departing from its spirit or essential characteristics.

Figure 5:
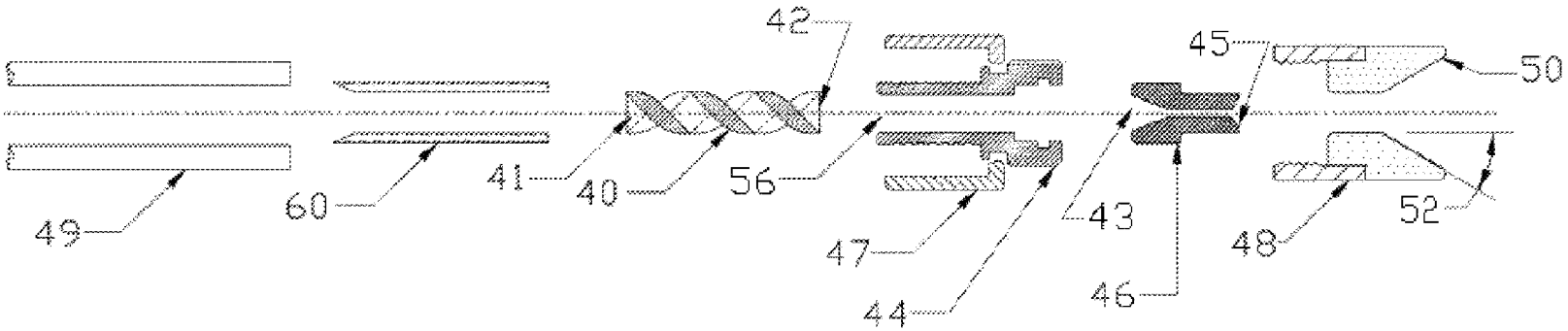
FIG. 5 is an exploded cutaway view of a nozzle assembly of an aspect of the present disclosure.

An exploded view of the novel nozzle configuration of an aspect of the present disclosure is depicted in FIG. 5. A helix or spring 40 is placed in a high-pressure hose 49 (See FIG. 6) and creates rotation of the fluid as the cutting fluid passes from the proximate end 41 to the distal end 42 of the helix 40. It should be noted that the helix or spring 40 could be of any configuration that increases the RPM of the cutting fluid as it pass from the proximate end 41 to the distal end 42 of the helix 40. In this disclosure the term helix is not meant to limit the invention in any sense. A helix is contemplated by the present invention to be any structure that is capable of being inserted into the high-pressure hose 49 and provide a RPM increase as stated above.

The helix or spring 40 can be comprised of a single piece of metal resembling a drill bit or be a wire coiled into a spring, but is not limited to these configurations. A person of ordinary skill in the art will appreciate that based on the principles of fluid mechanics that varying the helix shape may be necessitated to provide superior efficiencies and energy transfer based on the cutting fluid involved and the desired working cutting pressures. An aspect of the present invention is to determine the optimum parameters necessary to produce such results and to vary the components and their dimensions and compositions to achieve the desired yield.

Typically, the helix 40 is comprised of, but not limited to, ceramic, or silicon carbide, or tungsten carbide or boron carbide, or other abrasive resistant material.

In an aspect of the present invention the helix 40 is approximately 25 mm in length. Furthermore, since the high-pressure-hose 49 size can vary and the working environment can change, i.e. well bore size changes from a larger to smaller bore diameter, the length and composition of the helix may necessitate changes to accommodate them down the borehole.

The helix 40 is such that from the proximate end 41 to the distal end 42 the turn ratio of the helix varies from 90 degrees to 360 degrees over a ratio length distance of degree turn to length of the helix. The ratio is determined based on the cutting fluid velocity passing the helix and the resulting rotating jet fluid velocity desired of the exiting fluid jet stream required for increased distance cutting through water by exceeding the water pressure vapor of the water the abrasive-fluid-jet stream is traveling through, allowing the abrasive-fluid-jet stream to travel through the generated water vapor gas. For instance in a cutting fluid slurry including garnet the outer rotating vortex fluid velocity has to be approximately 70 meters per second depending on water depth, density and temperature to exceed the water vapor pressure. The guiding principle behind the turn ratio of the helix 40 is to create a vortex after the abrasive-fluid jet-nozzle distal end 45 and lower pressure, whereby the cutting length of the exiting abrasive-jet-fluid, is increased by the jet-fluid vortex stream.

Returning to the embodiment depicted in FIG. 5, the hose 49 is attached to a nozzle holder assembly 44 via a ferrule 47 (See FIG. 6). A jet-nozzle 46, comprised of a hard material, such as but not limited to silicon carbide or boron carbide steel or similar material, is inserted into the nozzle holder assembly 44. A nozzle end retainer 48 is then placed over the distal end 45 of the jet-nozzle 46 and secured (e.g. screwed) in place.

FIG. 6 illustrates an assembled view of the hose-nozzle assembly of one embodiment. Hose 49 is a high-pressure type hose, typically having an inner-plastic polyamide type lining. In an aspect of the present invention the hose 49 is a 12 mm I.D. hose produced by Parker Polyflex. The hose 49 is capable of sustaining high-pressure fluid in the 1,300 bar range.

By way of example, the abrasive cutting fluid traverses the hose 49 and engages the proximal end 41 of helix 40 at about 8.8 meters per second and is split into two flows around the helix 40 and begins to rotate about the helix 40. As the abrasive-cutting-fluid progresses beyond the distal end 42 of helix 40 the abrasive cutting fluid is now rotating and has increased in velocity to about 26.9 meters per second as the helix 40 area is less than the area of the hose 49 before the helix 40. Stepping up the velocity of the motive fluid from the hose 49 through the helix 40 gives time for the abrasive particles to accelerate to about 80% of the motive fluid velocity. Just as one uses the on ramp to accelerate to the traffic flow on an expressway, there is a time factor for acceleration of the abrasive particles not considered by others. The resultant rotation of the abrasive cutting fluid exiting the jet-nozzle 46 creates a vortex that increases the outer velocity of the abrasive cutting fluid thereby decreasing the pressure aiding in cavitation bubble formation. In an aspect of the present invention the increase in the cutting fluid velocity is increased multiple times and theoretically higher velocity by the converging-diverging jet-nozzle 46 to approximately 700 meters per second exit speed of the motive fluid. As the abrasive-cutting-fluid exits helix 40, the abrasive cutting fluid has increased in velocity because of the smaller area through the helix 40 enters into a smaller diameter 37 cavity in the nozzle retainer 44 where the two split flows from the helix 40 are merged together prior to the jet-nozzle 46. The velocity then increases as the abrasive-cutting-fluid passes through jet-nozzle 46 according to the diameter of the jet-nozzle 46 orifice and the volume of the motive fluid dragging along the abrasive particles to exit the jet-nozzle 46 at high velocity. Additionally, as the abrasive-cutting-fluid traverses across the helix 40, the RPM of the abrasive-cutting-fluid increases from zero at the proximate end 41 of the helix 40 to about 30,000 RPM after the distal end 42 of the helix 40. The velocity of the rotating abrasive-fluid flowing from the distal end 42 of the helix 40 has increased because of the helix's 40 smaller flow area than the hose's 49 flow area. After the rotating abrasive-fluid exits the distal end 42 of the helix 40, its velocity again increases as it passes through the smaller inside diameter 39 of nozzle holder 44. The rotating abrasive-motive fluid flow's huge velocity increase is because of the converging input taper of the proximate end 43 of the jet-nozzle 46 and the 1.2 mm orifice diameter of the jet-nozzle 46 to a velocity about 700 meters per second. The abrasive particles achieve about 80% of the motive fluid flow or about 560 meters per second.

The jet-nozzle 46 is tuned by measuring the pressure at the jet-nozzle 46 proximate entrance region 43 using a pressure gage and mass flow rate with a transit time ultrasonic flow meter across the jet-nozzle throat and trimming the nozzle distal exit end length 45 until there is a decrease of back pressure at the jet-nozzle 46 proximate entrance region 43 and increase flow rate through the jet-nozzle 46. After the maximum jet velocity is achieved, any additional length of the nozzle throat causes resistance from the effect of the jet-nozzle throat wall friction due to a longer than necessary throat length. By shorting the jet-nozzle 46 length, the jet-nozzle can deliver the maximum force possible from inside of the jet-nozzle 46 to the exit or distal end 45 of the jet-nozzle 46. The length of jet-nozzle 46 is about 10 times the orifice diameter of the jet-nozzle 46 excluding the length of jet-nozzle 46 converging taper proximate entrance 43. Most existing jet-nozzles throat lengths are about 40 times the orifice diameter, which may decrease the energy transferred from the jet-nozzle to the intended target because of jet-nozzle throat wall friction, where the maximum jet-nozzle velocity has occurred upstream in the nozzle throat before the exit or distal end of the jet-nozzle.

In one embodiment, the distal end 45 of jet-nozzle 46 is tapered to about 60-degrees. This diverging tapering is determined such that the transition from the high velocity of the abrasive cutting fluid from the end of the jet-nozzle 46 to a target 58 via the abrasive-cutting-fluid 56 can achieve maximum cutting length. In an aspect of the present invention the tapering 50 is approximately 30-degrees. The 60-degree beveling of the distal end 45 of jet-nozzle 46 is configured for diverging and increasing the velocity of the motive fluid to transfer the maximum amount of energy to the target 58.

As further depicted in FIG. 6, the abrasive-cutting-fluid 56 exiting the jet-nozzle 46 expands to a fan 54 to allow the complete nozzle hose assembly to pass through an eroded hole 51 through target 58 if desired. A void 52 is created in area 52 between the fan 54 and the nozzle end retainer 48. This void 52 aids in the cutting of the target by preventing the shearing of the exiting abrasive-jet-fluid 56 from the jet-nozzle 46. Although not to scale in the figure, the vortex creates a cutting action that creates an opening in the target 58 about 32 mm in diameter which is greater than the nozzle retainer 48 diameter (e.g. about 25 mm). One can observe the abrasive-jet-fluid vortex cutting by viewing a target that is not completely cut where a slug 59 remains until the cut is completed.

In Empirical tests, a 50 mm diameter hole was drilled 5 meters deep through wet soil in two minutes, with the jet-nozzle 46 pointing toward the ground with the hose 49 and jet-nozzle 46 two-feet from the ground while being suspended by two 12 mm bungee cords. The jet-nozzle 46 was stable and had no observed whip.

Figure 7:
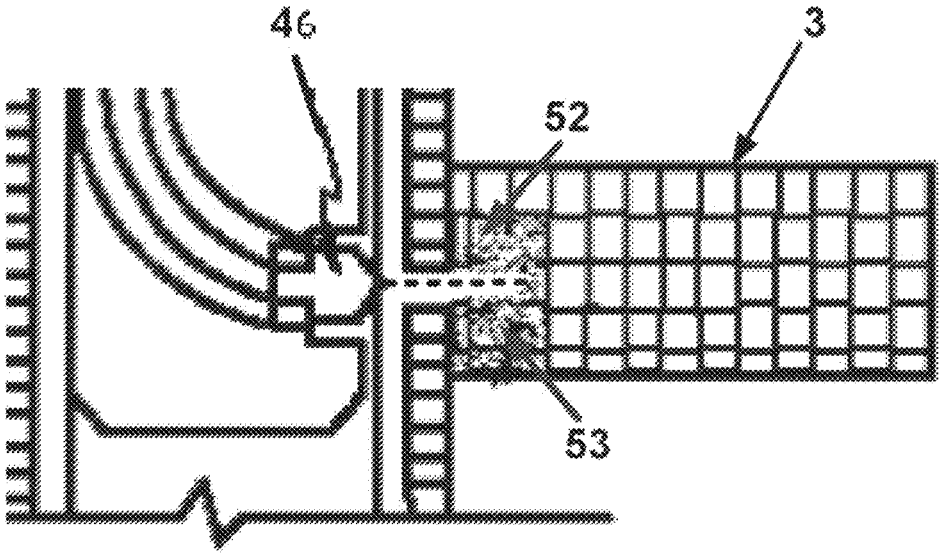
FIG. 7 is an expanded view of FIG. 1 depicting an aspect of the present disclosure in operation.

As depicted in FIG. 7, once the abrasive-cutting-fluid stream 56 penetrates the target the vortex 52 begins eroding away any material on the rear of target 58. The darkened regions 53 represent the vortex and the action of the abrasive cutting fluid on the backside of the target. This cyclonic action also creates a hole in the target of greater diameter than the abrasive-cutting-fluid stream 56, as previously stated. Furthermore the cyclonic action removes cement and produces a backpressure on the rear of the target and assists in the removal of any pattern cut from the target material (e.g. well bore casing).

FIG. 7 depicts an exemplary view of the novel cutting nozzle in operation. As can be seen in FIG. 7, a cutout design is depicted, wherein the control system has mapped out and cut the predetermined design, here a rectangular pattern, in the well casing bore. As can be seen in the pattern, the edges are clean as if machined and are substantially perpendicular to the cut. The cyclonic action of the cutting fluid as produced by the novel nozzle configuration cleans the back surface of the bore casing.

The cutting continues in the rock or substrate region extending further into the rock or substrate formation making small pebbles out of the solid formation rock. Without any additional lateral movement the present invention can cut approximately a one meter pattern into the surrounding strata in 5 minutes or less, depending on the strata composition. In the exemplary view and case the strata was a standard rock formation encountered typical in oilfields.

An aspect of the present invention contemplates any determined turns ratio from the proximate end 41 to the distal end 42 of the helix 40 that increases cutting fluid velocity and aides in delivering the maximum amount of cutting energy to the target.

Although described specifically as cutting a greater diameter than the nozzle retainer 48, the jet-nozzle can also perform very precise cutting with minor changes such as increasing the length of jet-nozzle 46 to decrease fan width 56.

Figure 8:
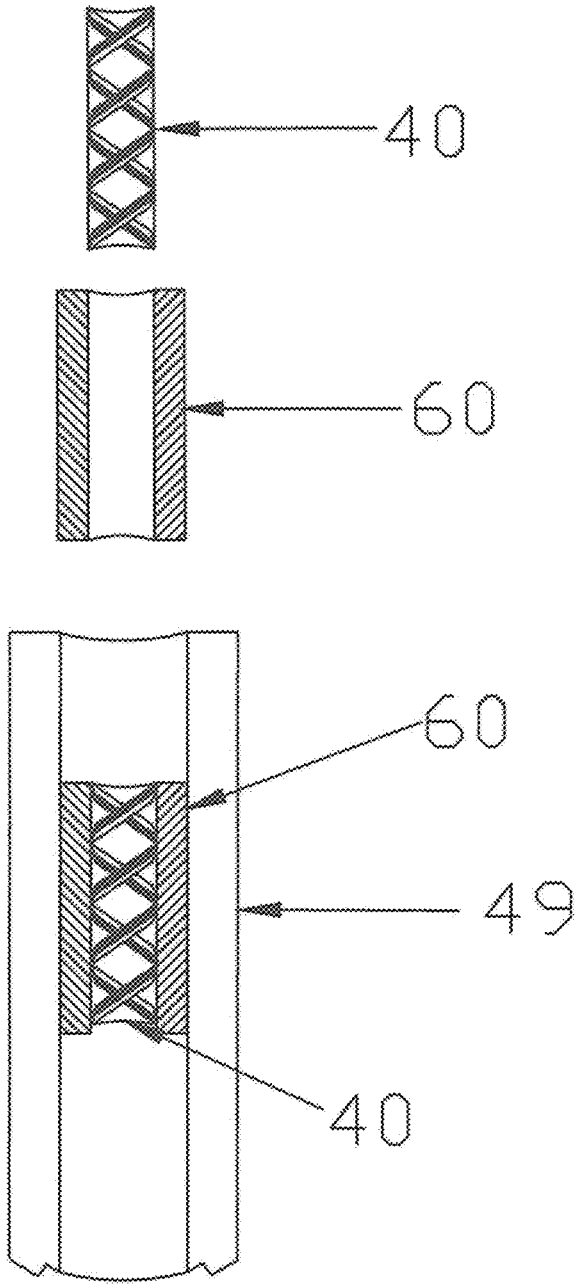
FIG. 8 is an exploded view of an alternative embodiment of the helix and hose assembly.

FIG. 8 depicts an alternate embodiment of the jet-nozzle 46 and the hose-nozzle assembly. In this embodiment, the helix 40 is inserted into a sleeve 60. The sleeve 60 could be made using a variety of materials including nylon. The outer diameter (OD) of the helix 40 and the inner diameter (ID) of the sleeve 60 are such that the helix 40 will not rotate within the sleeve 60 even when the abrasive cutting fluid traverses across the helix 40. The sleeve 60 is inserted into the hose 49, which is also a tight enough fit to keep the sleeve 60 from rotating within the hose 49.

A ferrule 47 is placed onto the hose 49 and the hose 49 is inserted over the nozzle holder assembly 44. The ferrule 47 is crimped to secure the hose 49 to the nozzle holder assembly 44. It is important to ensure the crimp is sufficient to keep the nozzle holder assembly 44 attached to the hose 49 under pressure.

After crimping the ferrule 47 onto the hose 49 a hole gage is inserted into the end of the nozzle holder 44 and the inside diameter 39 of the nozzle holder assembly 44 should be about 0.7 mm smaller inside diameter 39 than before the ferrule 47 was crimped to insure that the nozzle holder assembly 44 will hold the high-pressure safely. The total crimp length is about one-third the length of a normal commercial fitting and is necessarily short to allow the nozzle assembly 44, with the nozzle retainer 48 attached, to turn in a short radius inside smaller well bores in order to face the target to be cut.

The smaller inside diameter 39 of the nozzle holder assembly 44 also increases the abrasive-cutting-fluid 56 velocity before entering the converging input taper of the jet-nozzle 46 proximate end 43.

Stair stepping the abrasive-cutting-fluid 56 velocity, first through the helix, 40 then the nozzle holder assembly, 44 and the converging jet-nozzle 46 gives acceleration time for the abrasive particles to come closer to the velocity of the motive fluid. The velocity of the abrasive-cutting-fluid 56 exiting the jet-nozzle 46 extends the distance a target may be cut from the jet-nozzle exit distal end 45.

Continuing with this embodiment, the jet-nozzle 46 is inserted into the nozzle holder assembly 44 and the nozzle holder assembly 44 is secured into the nozzle end retainer 48. The sleeve 60, and consequently the helix 40, are arranged close (or even touching) the proximate end 43 of the nozzle holder assembly 44. This placement permits the jet nozzle to operate in narrow well bore casings (e.g. 101 mm).

Still continuing with this embodiment, the nozzle end retainer 48 is angled at about 30 degrees 50 (although other angles could also be employed) in a conical shape. The jet-nozzle 46 extends into the base of this "cone" and extends substantially to the distal end 45 of the nozzle end retainer 48.

The jet-nozzle 46 is a converging-diverging nozzle that allows the abrasive fluid discharge velocity to create cavitations in water.

Cavitation is a phenomenon known to engineers in the field of fluid dynamics wherein small cavities of a partial vacuum form in a liquid substance wherein the cavities then rapidly collapse. In one example, cavitation occurs when water is forced to move at extremely high speed (e.g. in fluid flows around an obstacle such as a rapidly rotating propeller). In such an example, the pressure of the fluid drops due to its high speed flows (Bernoulli's principle). When the pressure drops below its saturated vapor pressure, it creates a plurality of cavities in the water-hence the term cavitation. The cavities can take on a number or forms and configurations that all consist of regions or bubbles of a partial vacuum, i.e., very low pressure gas phase water.

The high velocity rotating jet exiting from the nozzle creates a vortex, whereby cavitation gas bubbles are generated along the downstream path of the abrasive/jet flow, by the rapid fluid pressure drop due to the high velocity and rotation of the water jet stream (Bernoulli's principle). The resulting downstream gas pathway created by the cavitation gas in the water, allows the abrasive/jet stream maximum possible impact momentum onto a downstream under water steel target 600 mm away from the nozzle.

In real world under-water tests, the abrasive/jet stream (80 grit size abrasive media) traveling through the gas pathway created by the cavitation gas in the water, impacting a downstream steel target, crushes the 80 grit size abrasive media into smaller abrasive media, where the resulting crushed abrasive media will pass through a USS 200 mesh.

Therefore, as the coherent abrasive laden cutting-fluid traverse along the hose 49 under pressure, the abrasive cutting fluid is forced across the helix 40. Because the helix 40 is disposed within the sleeve 60, the abrasive-cutting-fluid's path is further constricted which raises the abrasive-cutting-fluid's velocity as it traverses across the helix 40. Additionally, as the abrasive cutting fluid traverses across the helix 40, the helix 40 makes the fluid rotate creating a vortex as the abrasive/fluid exits the jet-nozzle 46. As the abrasive cutting fluid traverses from the proximate end 43 to the distal end 45 of the jet-nozzle 46, the abrasive-cutting-fluid's path is further restricted and the velocity is consequently increased by the nozzle converging taper. As the abrasive-cutting-fluid exits the distal end 45 of the jet-nozzle 46, the abrasive cutting fluid is traveling at about 700 meters per second.

Figure 9:
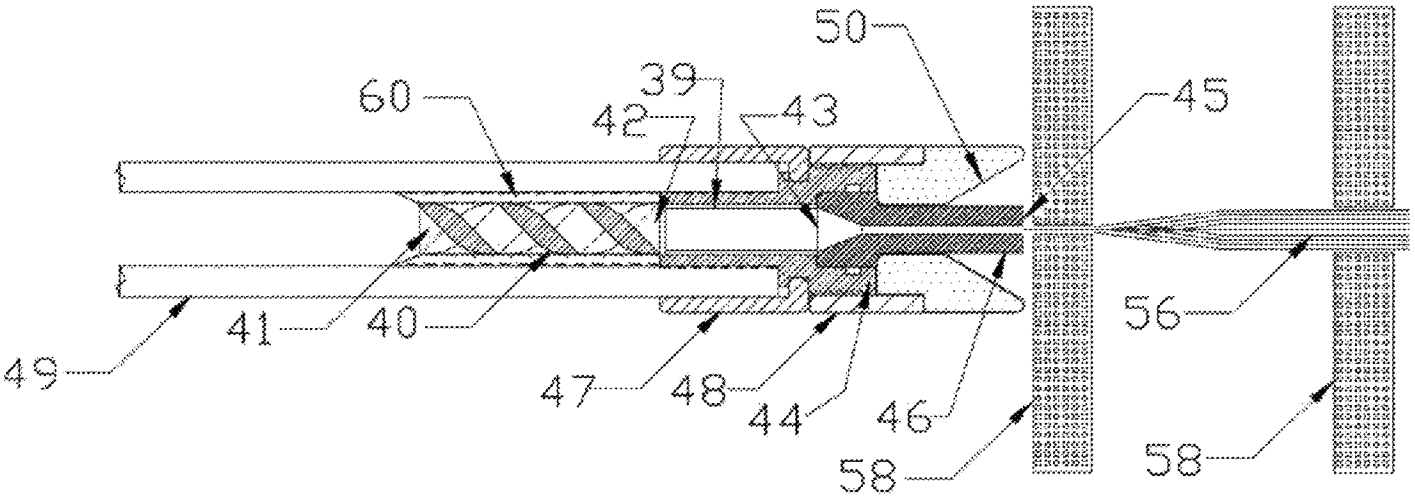
FIG. 9 is an exploded cutaway view of an embodiment of the nozzle assembly of an aspect of the present disclosure.

FIG. 9. Although described specifically as cutting a greater diameter than the cutting nozzle, the nozzle can also perform very precise cutting with minor changes such as increasing the length of jet-nozzle 46 to decrease abrasive-jet width 56.

At speeds above about 70 meters per second cavitation occurs in water. Cavitation is the phenomenon where small cavities (e.g. bubbles) of a partial vacuum form in a liquid and then rapidly collapse. Cavitation is generally a very destructive force and this is the phenomenon that greatly contributes to existing nozzles destroying themselves within a matter of minutes (similar to propeller blades).

The abrasive-fluid is compressed about 5% at 1,100 bar and that denser compressed water expands when the abrasive fluid exits the nozzle helping create a pressure change that might enhance the formation of water vapor.

Additionally, it is believed that the extreme distances the presently disclosed nozzle can cut are accomplished by the vortex and, when disposed within a liquid, supercavitation. In air, the abrasive-jet fluid from the vortex nozzle has cut through steel 4.5 meters from the nozzle end. It is believed that this is accomplished because the vortex does not allow the air to shear the jet-force energy from the abrasive-jet-fluid stream, much like a rotating tornado vortex allows the high velocity jet stream energy to travel thousands of feet down to the earth. Supercavitation is a theory whereby as an object travels through a liquid where cavitation has created a large bubble of gas surrounding the object. This drastically increases the distance an object can travel through the liquid because the object is traveling in gas instead of the liquid. It is believed that such a gas bubble is created when the abrasive cutting fluid exits the jet-nozzle 46 at high speed.

The described embodiments are to be considered in all respects only as illustrative and not restrictive. It will be apparent to those skilled in the art that various modifications and variations can be made in the System and Apparatus for Jet-Fluid Cutting Nozzle of the present disclosure and in construction of this disclosure without departing from the scope or intent of the disclosure.

Other embodiments of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

What is claimed is:

1. Apparatus for cutting through a target, the apparatus comprising:

a high-pressure hose, said high-pressure hose at least internally lined substantially with an abrasive resistant material, said abrasive resistant material either a non-rigid abrasive resistant material or a rigid abrasive resistant material;

a helix disposed within said high-pressure hose between a jet-nozzle and any significant bend in said high-pressure hose, said helix externally lined throughout the surface area substantially with a first rigid abrasive resistant material;

said jet-nozzle associated with said high-pressure hose, said jet-nozzle at least internally lined substantially with a second rigid abrasive resistant material;

a coherent abrasive jet-fluid, said coherent abrasive jet-fluid containing a solid abrasive and traveling under pressure through said high-pressure hose, over said helix, and through said jet-nozzle;

wherein said abrasive-jet-fluid is used to cut said target.

2. The apparatus according to claim 1, wherein the length of a fully constricted portion of said jet-nozzle to a distal end of said jet-nozzle and the length of said high-pressure hose to a distal end of said jet-nozzle is less than 50 mm.

3. The apparatus according to claim 1, wherein a distal end of said jet-nozzle is tapered.

4. The apparatus according to claim 1, wherein said jet-nozzle is comprised of:

a nozzle holder assembly, wherein said high-pressure hose is associated with said nozzle holder assembly;

a nozzle;

a nozzle end retainer, wherein said nozzle is positioned between within said nozzle end retainer and said nozzle holder assembly and said nozzle end retainer compresses said high-pressure hose between said nozzle holder assembly and said nozzle end retainer.

5. The apparatus according to claim 4, wherein a distal end of said nozzle end retainer is tapered.

6. The apparatus according to claim 5, wherein said tapering of said distal end of said nozzle end retainer is approximately 30 degrees.

7. The apparatus according to claim 4, wherein said nozzle extends through said nozzle end retainer and through said tapering such that a distal end of said nozzle substantially aligns with said distal end of said nozzle end retainer.

8. The apparatus according to claim 4, wherein the length of said jet-nozzle is tuned so the maximum velocity of said coherent abrasive jet-fluid occurs at a distal end of said jet-nozzle, said tuning accomplished by measuring the mass flow and pressures of said jet-nozzle and adjusting said jet-nozzle length until there is a decrease of back pressure at the proximate end of said jet-nozzle.

9. The apparatus according to claim 1, wherein said helix is disposed within a sleeve, said sleeve disposed within said high-pressure hose.

10. The apparatus according to claim 9, wherein said helix and said sleeve are positioned against a proximate end of a nozzle holder assembly.

11. The apparatus according to claim 1, wherein said helix has a larger outer diameter than the inner diameter of a nozzle holder assembly.

12. The apparatus according to claim 1, wherein said helix has an outer diameter sufficiently larger than an inner diameter of said high pressure hose such that said helix remains stationary when said high pressure fluid traverses said helix.

13. The apparatus according to claim 1, wherein said coherent abrasive-jet-fluid is pumped under high-pressure between a range of 690 bar and 2,750 bar.

14. The apparatus according to claim 1, the apparatus capable of cutting through said target, wherein said target is a 19 mm thick piece of steel positioned 1.5 meters from said jet-nozzle and said cutting is performed in the air.

15. The apparatus according to claim 1, the apparatus capable of cutting through said target, wherein said target is 600 mm thick steel reinforced concrete and said cutting is performed in the air.

16. The apparatus according to claim 1, the apparatus capable of cutting said target, wherein said target is a 380 mm thick steel and said cutting is performed in the air.

17. The apparatus according to claim 1, the apparatus capable of being deployed within a well bore with an internal diameter of 101 mm.

18. The apparatus according to claim 1, wherein said target is steel casing(s), cement, and/or formation rock and said target is cut at least two feet from said jet-nozzle while said jet-nozzle is submerged in a liquid.

19. The apparatus according to claim 18, said jet-nozzle cutting through and severing from an inner diameter of a casing through five cemented nested casings with the largest nested casing being one meter in diameter.

20. The apparatus according to claim 1, wherein said target is 19 mm thick steel casing(s), cement, and/or formation rock and said target is cut at a rate of at least 300 mm length per minute while said jet-nozzle is submerged in a liquid.

21. The apparatus according to claim 1, said jet-nozzle submerged within a liquid and cutting while submerged in said liquid.

22. The apparatus according to claim 1, wherein said target is casing(s), cement, and/or formation rock and said cutting is performed at greater than 6 km depth while submerged in a liquid.

23. The apparatus according to claim 1, wherein said target is a casing and/or subterranean formation.

* * * * *